US008577253B2

(12) United States Patent
Mori et al.

(10) Patent No.: US 8,577,253 B2
(45) Date of Patent: Nov. 5, 2013

(54) IMAGE FORMING APPARATUS

(75) Inventors: Hirotaka Mori, Nagoya (JP); Masato Makino, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 201 days.

(21) Appl. No.: 13/028,580

(22) Filed: Feb. 16, 2011

(65) Prior Publication Data

US 2011/0200355 A1 Aug. 18, 2011

(30) Foreign Application Priority Data

Feb. 17, 2010 (JP) ..... 2010-032283

(51) Int. Cl.
*G03G 15/00* (2006.01)

(52) U.S. Cl.
USPC ..... 399/110; 399/121

(58) Field of Classification Search
USPC ..... 399/110, 121
See application file for complete search history.

(56) References Cited

U.S. PATENT DOCUMENTS

| | | | | |
|---|---|---|---|---|
| 7,751,750 | B2 | 7/2010 | Shoji | |
| 2007/0231003 | A1* | 10/2007 | Shoji | 399/121 |
| 2008/0138112 | A1* | 6/2008 | Nakashima | 399/121 |

FOREIGN PATENT DOCUMENTS

| | | | |
|---|---|---|---|
| JP | 2001-109358 | A | 4/2001 |
| JP | 2007-101728 | A | 4/2007 |
| JP | 2007-264350 | A | 10/2007 |
| JP | 2008203741 | A | 9/2008 |
| JP | 2010-002590 | A | 1/2010 |

OTHER PUBLICATIONS

First Office Action issued in corresponding Chinese Patent Application No. 201110043092.8 mailed Jun. 3, 2013.
Notice of Reasons for Rejection issued in corresponding Japanese Patent Application No. 2010-032283, mailed Jun. 18, 2013.

* cited by examiner

*Primary Examiner* — Ryan Walsh
(74) *Attorney, Agent, or Firm* — Banner & Witcoff, Ltd.

(57) ABSTRACT

An image forming apparatus may include a removable/attachable belt unit. In operation, the belt unit may be secured to a main body of the image forming apparatus using a lock mechanism to prevent extraneous or unexpected shifts and/or other movements. The lock mechanism may be located closer to a rotation pivot than to a midpoint between the rotation pivot and a rotation axis of a driven roller. This positioning of the lock mechanism may allow easier attachment and removal of the belt unit. Additionally, the lock mechanism may include an urging member configured to sandwich a protruding member of the belt unit against a contact surface in a front-rear direction. This reduces the potential for elastic or creep deformation of the belt unit.

20 Claims, 9 Drawing Sheets

IMAGE FORMING APPARATUS

CROSS REFERENCE TO RELATED APPLICATION

This application claims priority from Japanese Patent Application No. 2010-032283, filed on Feb. 17, 2010, the content of which is incorporated herein by reference in its entirety.

TECHNICAL FIELD

Aspects of the disclosure relate to an image forming apparatus.

BACKGROUND

Some existing image forming apparatuses may include: a main body having an opening; an image forming unit that is disposed in the main body and configured to form an image on a recording medium; a belt unit detachably attached in an operation position where the belt unit faces the image forming unit in the main body and configured to hold an endless belt rotatably and feed the recording medium; and a pair of lock mechanisms disposed in the main body and configured to fix the belt unit in the operation position by applying an urging force to the belt unit. The belt unit is configured to be inserted from an exterior of the image forming apparatus into the operation position along an attachment direction from the opening of the main body toward the operation position.

In the existing image forming apparatuses, the belt unit includes a pair of pivot shaft portions disposed on a front side relative to the attachment direction. The pivot shaft portions protrude outward in a width direction of an endless belt. The endless belt is wound around a drive roller and a driven roller which are rotatably supported at the front side and a rear side of the belt unit with respect to the attachment direction. The driven roller's shaft protrudes outward in the width direction of the endless belt, and both ends of the shaft function as a pair of engaging protruding portions.

Furthermore, the main body of the existing image forming apparatuses may also include a pair of pivot support portions. When the belt unit is attached to the main body, the pivot support portions are configured to engage the pivot shaft portions of the belt unit so as to support the belt unit such that the belt unit is able to pivot around a horizontal pivot axis that is perpendicular to the attachment direction.

Each lock mechanism of the existing image forming apparatuses is configured to contact a corresponding one of the engaging protruding portions when the belt unit pivots around the pivot axis during attachment, so as to apply tension to the endless belt and fix the belt unit in the operation position.

In the existing image forming apparatuses, to attach the belt unit to the main body, the user holds the rear side (on which a finger engageable portion is disposed near the driven roller) of the belt unit in the attachment direction and inserts the front side of the belt unit through the opening into the main body. After engaging the pivot shaft portions of the belt unit with the pivot support portions of the main body, the user presses the rear side (the finger engageable portion) of the belt unit downward, causing the belt unit to pivot around the pivot axis. At this time, the lock mechanisms contact the respective engaging protruding portions so as to apply an urging force thereto, and the user presses the belt unit downward against the urging force of the lock mechanisms.

In the existing image forming apparatuses, as described above, a distance between a position where each lock mechanism applies the urging force to the corresponding engaging protruding portion (e.g., each end of the driven roller's shaft) and the pivot axis is generally equal to a distance between a pressing position (the finger engageable portion near the driven roller) where the user presses the belt unit to the operation position and the pivot axis. Accordingly, when the user presses the belt unit, the user is more susceptible to the urging force of the lock mechanism, and thus needs to press the belt unit downward with a great force to overcome the urging force. In addition, the tension applied by the lock mechanisms to the endless belt may result in a significantly large force being placed on the belt unit. Similarly, to remove the belt unit, the user may need to raise the belt unit with significant force.

SUMMARY

Aspects of the disclosure may provide an image forming apparatus in which a belt unit can be easily attached or removed (e.g., without requiring a user to exert a significantly large force).

BRIEF DESCRIPTION OF THE DRAWINGS

Illustrative aspects of the disclosure will be described in detail with reference to the following figures in which like elements are labeled with like numbers and in which.

DETAILED DESCRIPTION

An illustrative embodiment of the disclosure will be described in detail with reference to the accompanying drawings.

A first embodiment of the disclosure will be described.

Figure 1:
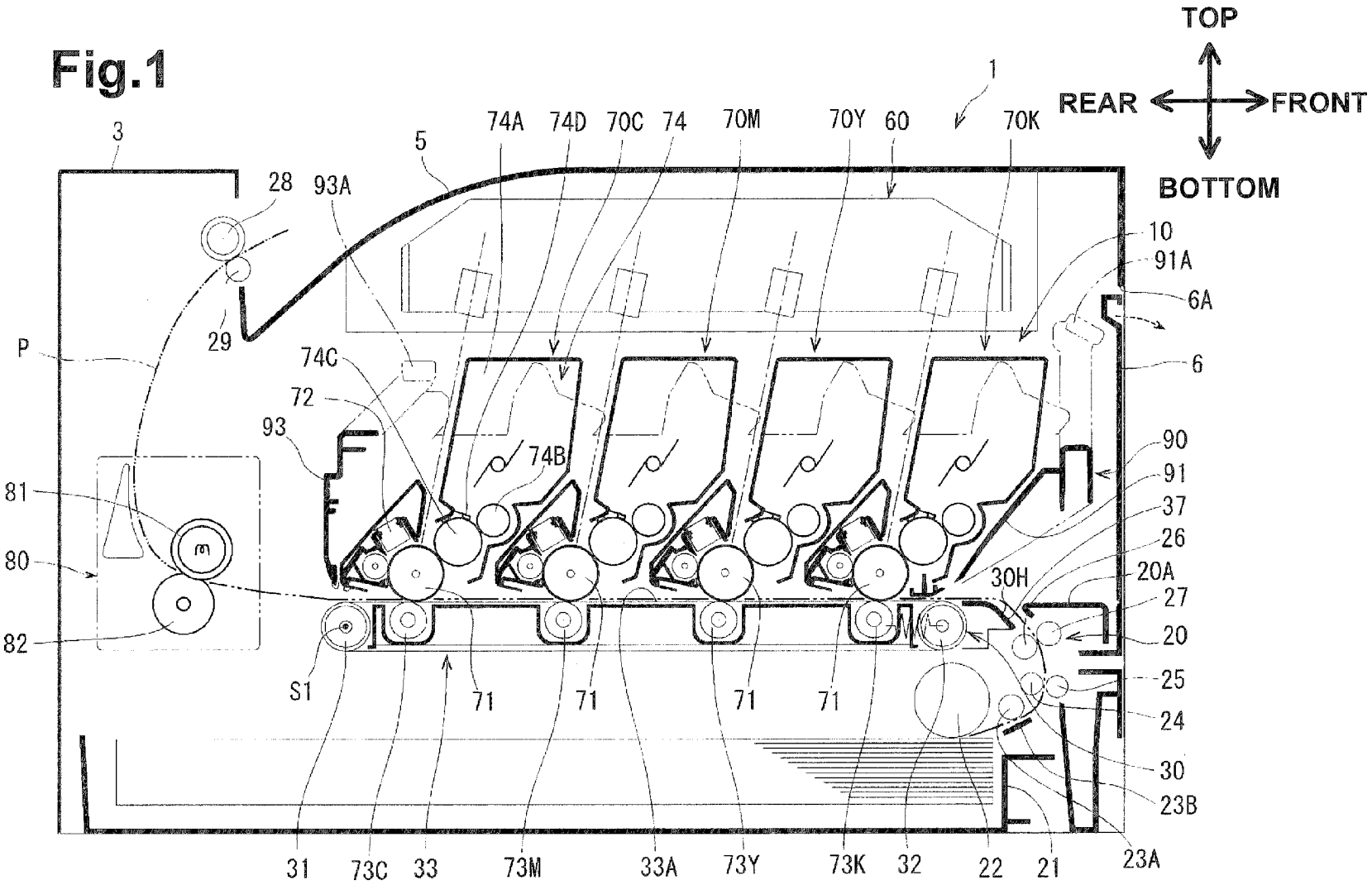
FIG. 1 is a sectional view schematically illustrating an image forming apparatus according to an illustrative embodiment.

As shown in FIG. 1, an image forming apparatus, e.g. a printer 1, is a color laser printer that electrophotographically forms a color image on a recording medium, e.g. plain and transparent sheets, which is hereinafter referred to as a recording sheet.

In FIG. 1, the right side of the drawing is referred to as the front or front side of the image forming apparatus, and the left side of the drawing is referred to as the rear or rear side of the image forming apparatus. When the image forming apparatus is viewed from the front side, the left side is referred to as the left or left side, and the right side is referred to as the right or right side. The directions, front, rear, left, right, top, and bottom, shown in each drawing are referenced based on the directions shown in FIG. 1.

A general structure of the printer 1 will be described.

Figure 5:
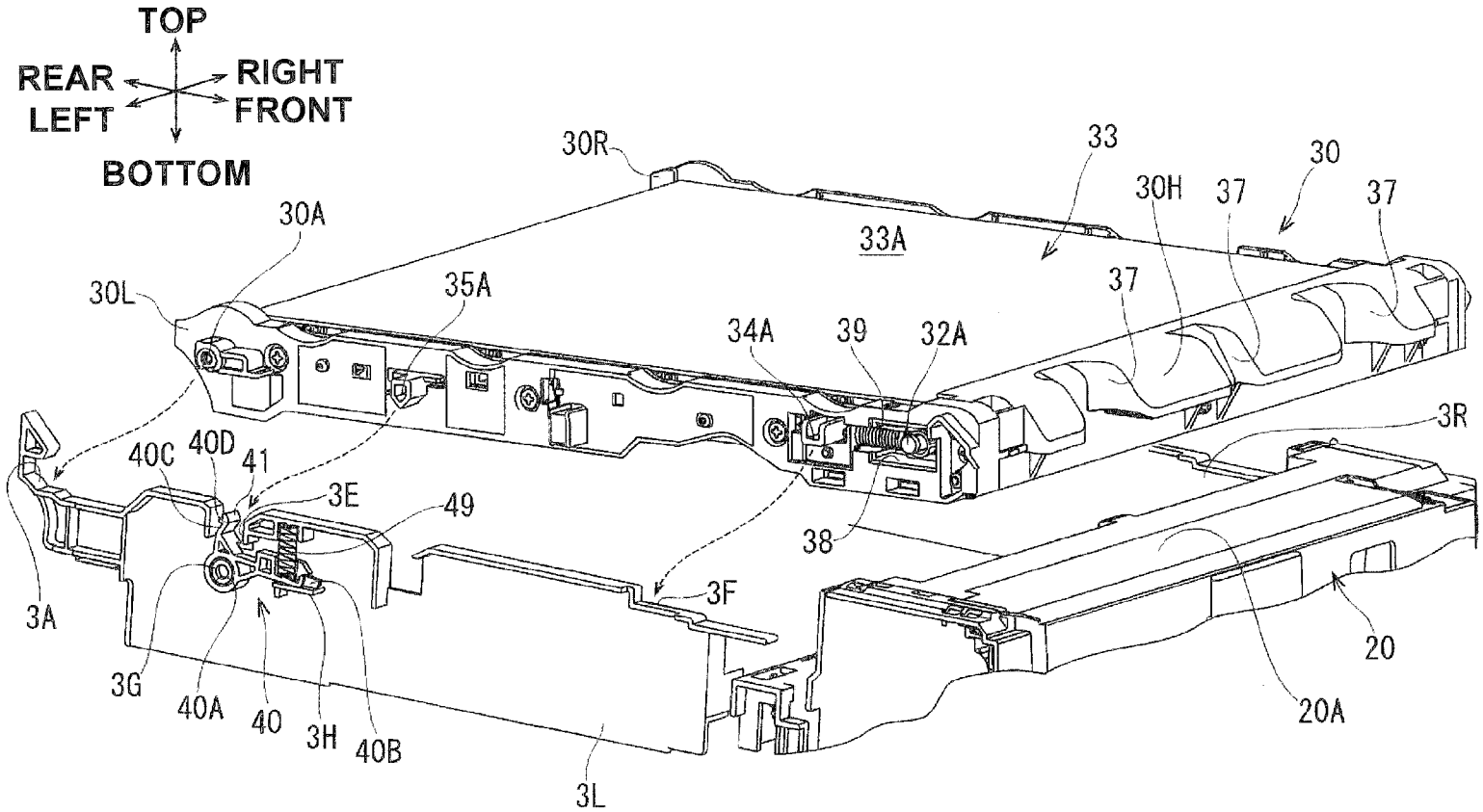
FIG. 5 is a perspective view illustrating the belt unit, the frame, and a sheet supply unit of the image forming apparatus (in a state where the belt unit is removed from the frame)

As shown in FIG. 1, the printer 1 may include a generally rectangular- or box-shaped housing 3 in which a frame comprised of a plurality of members is disposed. FIG. 5, for example, illustrates right and left sidewalls 3R and 3L which are lower sidewalls of the frame. Assembled to the frame are a sheet supply unit 20, an image forming unit 10, a belt unit 30, and a fixing unit 80. The image forming unit 10 is located in a middle portion of the housing 3.

A top surface of the housing 3 includes an output tray 5. The output tray 5 is configured to store recording sheets on which images have been formed, e.g., recording sheets that have been ejected by ejection rollers 28, 29 such that they are overlaid, one over the other. The front side of the housing 3 includes a front cover 6 which is pivoted about its lower end between a closed position as shown in FIG. 1 and an open position where an opening 6A is exposed on the front side of the housing 3 as shown in FIG. 2.

Figure 2:
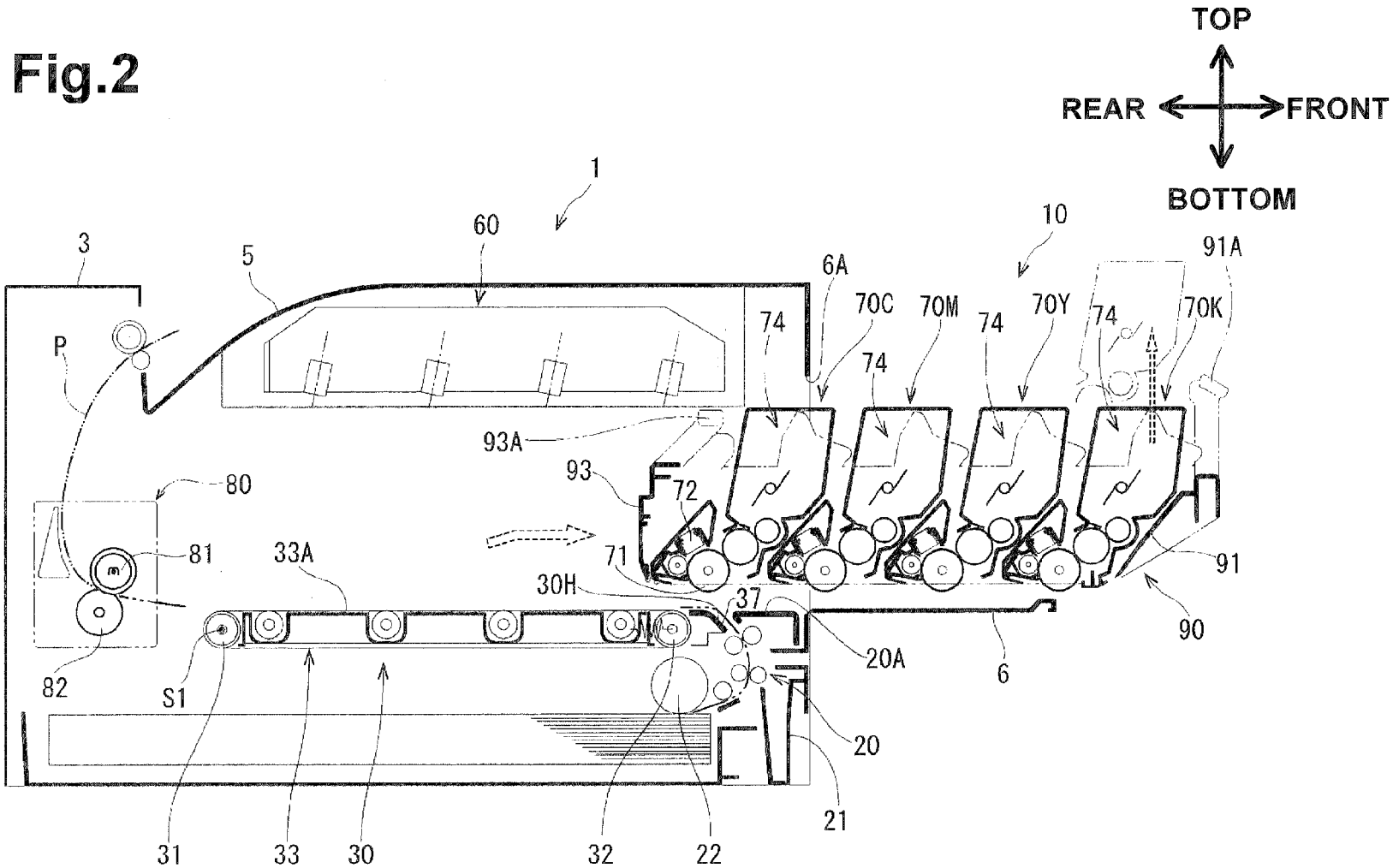
FIG. 2 is a sectional view schematically illustrating attachment/removal of an image forming unit to/from the image forming apparatus.
Figure 3:
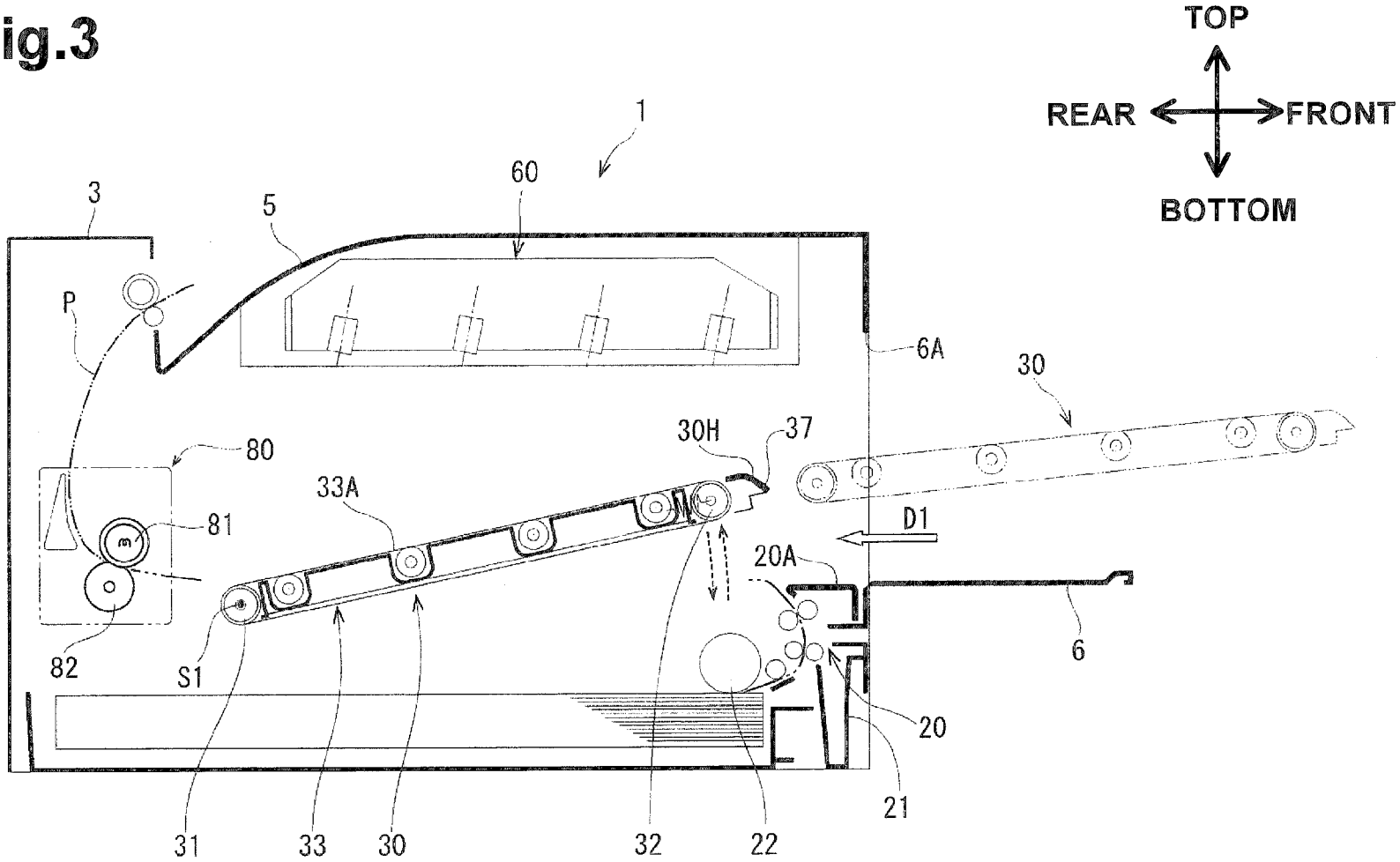
FIG. 3 is a sectional view schematically illustrating attachment/removal of a belt unit to/from the image forming apparatus.

As shown in FIGS. 2 and 3, the image forming unit 10 and the belt unit 30 are configured to be non-destructively attachable to and removable from the frame via the opening 6A. The housing 3 and the frame are an example of a main body. In this embodiment, a direction from outside of the main body via the opening 6A toward an inner portion in the main body is referred to as an attachment direction D1 (as shown in FIG. 3). In this case, direction D1 extends from a front side of the housing 3 (close to the front cover 6) to a rear side of the housing 3 (close to the fixing unit 80). With respect to belt unit 30, direction D1 extends from a rear side (e.g., a side to be attached or inserted last) to a front side (e.g., a side that is attached or inserted first into the main body).

The sheet supply unit 20 of the printer 1 will be described.

As shown in FIG. 1, the sheet supply unit 20 may include a sheet supply tray 21, a pickup roller 22, a separation roller 23A, a separation pad 23B, feed rollers 24, 25, and registration rollers 26, 27.

The sheet supply tray 21 is configured to store a stack of recording sheets and is disposed in a lower portion of the housing 3. The sheet supply tray 21 may be non-destructively attachable to and removable from the front of the housing 3. The pickup roller 22 is rotatably disposed in a front upper portion of the sheet supply tray 21 and configured to pick up sheets in the sheet supply tray 21 and feed them toward the image forming unit 10. The separation roller 23A and the separation pad 23B are configured to separate the sheets picked up by the pickup roller 22 one by one. The feed rollers 24, 25 are disposed downstream of the separation roller 23A and the separation pad 23B in a front-side u-turn portion of a sheet feeding path P, which is shown by a thick chain double-dashed line in FIG. 1. The feed rollers 24, 25 may also be configured to feed the sheet, which is separated by the separation roller 23A and the separation pad 23B, to the image forming unit 10. The registration rollers 26, 27 are disposed at a downstream side from the feed rollers 24, 25 in the sheet feeding path P and configured to contact the leading edge of the recording sheet, correct skew of the recording sheet and feed it further to the image forming unit 10.

The belt unit 30 of the printer 1 will be described.

Figure 4:
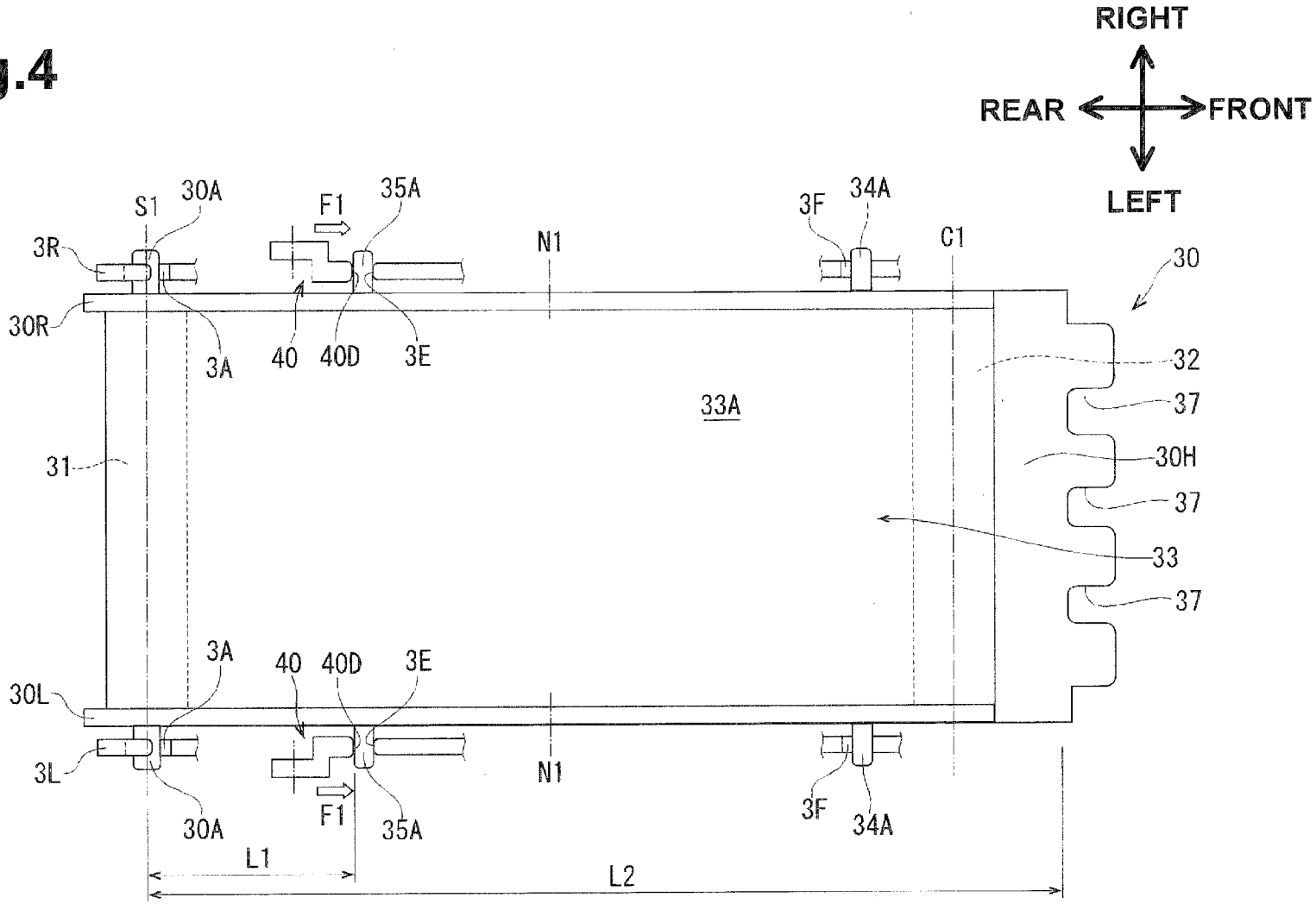
FIG. 4 is a top view of the belt unit and a frame of the image forming apparatus (in a state where the belt unit is fixed in an operation position)

The belt unit 30 is disposed between the sheet supply tray 21 and the image forming unit 10. As shown in FIGS. 1, 4 and 5, the belt unit 30 includes a drive roller 31, a driven roller 32, an endless belt 33, a right frame 30R (FIGS. 4 and 5), a left frame 30L (FIGS. 4 and 5), and a connection frame (not shown). The right and left frames 30R and 30L, which correspond to an example configuration of a belt unit body, support the drive roller 31 and the driven roller 32 rotatably at their front and rear ends and sandwich the endless belt 33 in a width-wise direction thereof. The front end and the rear end of the right and left frames 30R and 30L are examples of a first end and a second end, respectively. The endless belt 33 extends between the drive roller 31 and the driven roller 32. The right and left frames 30R and 30L are connected by the connection member inside the endless belt 33.

When the drive roller 31 rotates in synchronization with the sheet supply unit 20, the endless belt 33 is configured to circulate around the drive roller 31 and the driven roller 32. An upper surface of the endless belt 33 is disposed generally horizontally and immediately below the image forming unit 10. The upper surface is referred to as a sheet feeding surface 33A that feeds a recording sheet along the sheet feeding path P while contacting the back of the recording sheet immediately below the image forming unit 10.

Transfer rollers 73K, 73Y, 73M, and 73C are disposed between the drive roller 31 and the driven roller 32 inside the endless belt 33 as shown in FIG. 1. The transfer rollers 73K, 73Y, 73M, and 73C are rotatably supported by the right frame 30R and the left frame 30L in a state where they contact the endless belt 33 from the back side of the sheet feeding surface 33A. As the endless belt 33 is made of a conductive rubber, it is electrically charged by a negative charge (voltage) to be applied to the transfer rollers 73K, 73Y, 73M, and 73C. Thus, the endless belt 33 attracts a recording sheet to the sheet feeding surface 33A by static electricity and feeds the recording sheet along the sheet feeding path P.

As shown in FIG. 5, the front side of the left frame 30L is formed with an opening or hole 38 extending in the front-rear direction. In one example, the opening or hole 38 may be generally rectangular or elongated in shape. The opening or hole 38 receives a left end portion 32A of a shaft of the driven roller 32 therein such that the left end portion 32A is slidable in the front-rear direction. A compression coil spring 39 is disposed between a wall portion of the front side of the left frame 30L and the left end portion 32A. The compression coil spring 39 urges the left end portion 32A in a direction opposite the drive roller 31 (e.g., frontward). In one or more arrangements (not shown), the right frame 30R may also be formed with an opening or hole 38 and include a compression coil spring 39, as with the left frame 30L. Similarly, the right-side compression coil spring 39 urges a right end portion of the shaft of the driven roller 32 in the direction opposite the drive roller 31 (e.g., frontward). As a result, the tension is applied to the endless belt 33 in a direction extending between the drive roller 31 and the driven roller 32. As such, the hole or opening 38 and the compression coil spring 39 are an example of a tension applying mechanism.

The image forming unit 10 of the printer 1 will be described.

The image forming unit 10 employs a direct tandem system capable of color printing. As shown in FIG. 1, the image forming unit 10 includes a plurality of, e.g., four, process cartridges 70K, 70Y, 70M and 70C and a scanner unit 60. Any number of process cartridges may be used. The scanner unit 60 is disposed in a top portion inside the housing 3. The process cartridges 70K, 70Y, 70M and 70C respectively contain black toner (developer), yellow toner, magenta toner, and cyan toner. The process cartridges 70K, 70Y, 70M and 70C are disposed facing the sheet feeding surface 33A and arranged in line along the sheet feeding path P. The process cartridges 70K, 70Y, 70M and 70C are mounted in a drawer 90.

The scanner unit 60 will be described.

The scanner unit 60 includes laser light sources, a polygon mirror, fθ lenses, and reflecting mirrors. The scanner unit 60 has, e.g. four, laser light sources, which are provided for four colors of black, yellow, magenta, and cyan. A laser beam emitted from each laser light source, based on image data, may be deflected by the polygon mirror, pass through the fθ lenses, and be folded by the reflecting mirror to be directed to a surface of each photosensitive drum 71 of a corresponding one of the process cartridge 70K, 70Y, 70M and 70C, on which an electrical latent image is formed.

The process cartridges 70K, 70Y, 70M and 70C will be described with continued reference to FIG. 1.

The process cartridges 70K, 70Y, 70M and 70C are identical in structure but different in color of toner. Thus, while the following description is provided based on the process cartridge 70C, the structural and operational elements and configuration may be similarly or equally applicable to the other process cartridges 70K, 70Y and 70M.

The process cartridge 70C includes a photosensitive drum 71, a charger 72, and a toner cartridge 74, which are all known.

The toner cartridge 74 includes a toner chamber 74A, a supply roller 74B, a developing roller 74C and a layer-thickness regulating blade 74D. The toner chamber 74A is configured to store toner. The supply roller 74B is configured to supply toner in the toner chamber 74A to a surface of the developing roller 74C. The developing roller 74C is configured to supply the toner supplied from the supply roller 74B to a surface of the photosensitive drum 71. The layer-thickness regulating blade 74D is configured to regulate the toner carried on the surface of the developing roller 71 to a uniform thickness. The photosensitive drum 71 is disposed on a side opposite to the transfer roller 73C via the sheet feeding surface 33A of the endless belt 33.

The fixing unit 80 will be described.

The fixing unit 80 is disposed downstream from the process cartridges 70K, 70Y, 70M and 70C along the sheet feeding path P. The fixing unit 80 includes a heat roller 81 and a pressure roller 82. The heat roller 81 is disposed such that it faces a surface of a recording sheet on which an image has been formed. The heat roller 81 is configured to rotate in synchronization with the endless belt 33 and to feed the recording sheet while heating toner transferred onto the recording sheet. The pressure roller 82 is positioned facing the heat roller 81 and configured to rotate while pressing the recording sheet toward the heat roller 81. Thus, the fixing unit 80 is configured to melt the toner transferred onto the recording sheet by heat and fix the toner to the recording sheet, while feeding the recording sheet toward a downstream side of the sheet feeding path P. As illustrated in FIG. 1, the sheet feeding path P curves upward on the downstream side from the fixing unit 80. The ejection rollers 28 and 29 are disposed immediately before the output tray 5 which is disposed at the end of the sheet feeding path P. The ejection rollers 28 and 29 are configured to eject the recording sheet having an image formed thereon to the output tray 5.

In the printer 1 structured as described above, an image is formed on a recording sheet as follows.

When an image formation operation is started, the sheet supply unit 20 and the belt unit 30 operate to feed a recording sheet to the image forming unit 10, the scanner unit 60 and the process cartridges 70K, 70Y, 70M and 70C. During this time, the surfaces of the rotating photosensitive drums 71 are uniformly and positively charged by the respective chargers 72, and exposed to laser beams emitted from the scanner unit 60. As a result, electrostatic latent images based on image data are formed on the surfaces of the photosensitive drums 71.

In each of the process cartridges 70K, 70Y, 70M and 70C, positively charged toner is supplied through the supply roller 74B to the developing roller 74C upon rotation of the developing roller 74C. The toner is supplied to the surface of the corresponding one of the photosensitive drums 71. As a result, the electrostatic latent image formed on the surface of each photosensitive drum 71 becomes visible. In this manner, toner images are carried on the surfaces of the photosensitive drums 71.

The toner images carried on the surfaces of the photosensitive drums 71 are transferred onto a recording sheet by a voltage applied to the transfer rollers 73K, 73Y, 73M, and 73C. When the recording sheet having toner images is fed to the fixing unit 80, the fixing unit 80 melts toner by the application of heat, so that the toner images are fixed onto the recording sheet as an image. The recording sheet having the image is ejected to the output tray 5, which completes the operation for image formation.

A structure for attaching and removing the image forming unit 10 to and from the housing 3 will be described.

As shown in FIG. 1, the image forming unit 10 (with the exception of the scanner unit 60) is mounted in the drawer 90 which is an open topped and bottomed box member having a front wall 91 and a rear wall 93. The front wall 91 and the rear wall 93 are formed with handles 91A and 93A respectively, which protrude upward from their upper ends. In one configuration, the handles 91A and 93A are to be held by the user when the drawer 90 is attached to or removed from the housing 3.

The drawer 90 may have a generally known structure. The drawer 90 is mounted on known rail members (not shown), which are provided on the frame and extend in the front-rear direction, via cam followers. Each of the rail members is structured of an inclined rail portion at the rear end and a horizontal rail portion connected to the inclined rail portion and extending toward the front. When the drawer 90 is inserted all the way into housing 3 (e.g., to the rear ends of the inclined rail portions), each photosensitive drum 71 moves down to a position facing a corresponding one of the transfer rollers 73K, 73Y, 73M, 73C. Thus, the image forming unit 10 is positioned in a manner such that each photosensitive drum 71 is in contact with a corresponding one of the transfer rollers 73K, 73Y, 73M, 73C via the endless belt 33. In this position (e.g., when the image forming unit 10 is inserted all the way into housing 3), the image forming unit 10 applies a downward force to the belt unit 30.

As shown in FIG. 2, when the handle 91A is pulled toward the front with the front cover 6 being open, the drawer 90 moves obliquely upward along the inclined rail portions and the photosensitive drums 71 are separated from the endless belt 33. When the handle 91A is further pulled toward the front, the drawer 90 moves toward the front along the horizontal rail portions. Thus, the drawer 90 and the image forming unit 10 pass above the belt unit 30 and the sheet supply unit 20 and are pulled through the opening 6 outside the main body. When the drawer 90 is pulled completely out (e.g., to the front end of the rail portions), each toner cartridge 74 may be exposed outside of the opening 6A. In this position, each of toner cartridges 74 may be non-destructively attached to or removed from the drawer 90. The drawer 90 may be removed from the housing 3 at a position where the drawer 90 is pulled outside.

A structure for attaching the belt unit 30 to the main body will be described.

As shown in FIG. 1, when the belt unit 30 faces the image forming unit 10 in the housing 3, the belt unit 30 is in its operation position. In the printer 1, the belt unit 30 is configured to be set in the operation position by inserting the belt unit 30 through the opening 6 into the housing 3 along the attachment direction D1 as shown in FIG. 3, and removed from the housing 3 by pulling the belt unit 30 outward. A structure to attach and remove the belt unit 30 to and from the housing 3 will be described as follows.

As shown in FIGS. 4 and 5, the belt unit 30 includes a handle 30H that connects the right and left frames 30R and 30L at the front side. The handle 30H is formed with finger engageable portions 37 which are recessed from the front end toward the rear and open vertically. In one example, the finger engageable portions 37 may each be formed to have such a size that allows a finger to be inserted from above. As shown in the example embodiments of FIGS. 1 and 10, when the belt unit 30 is fixed in the operation position, a top surface of the handle 30H is flush with the sheet feeding surface 33A respect to the top surface 20A of the sheet supply unit 20.

As shown in FIG. 4, the right and left frames 30R and 30L include pivot shaft portions 30A which are disposed at the rear ends of each of right and left frames 30R and 30L (e.g., toward a destination side in the attachment direction D1, where the attachment direction D1 extends from an originating side to a destination side). The pivot shaft portions 30A are paired with each other and are disposed on the rotation axis of the drive roller 31, thereby sandwiching the endless belt 33 in the width-wise direction or right-left direction therebetween. As shown in FIG. 5, the pivot shaft portions 30A may have a column shape which protrudes outward in the width-wise direction of the endless belt 33. More specifically, in some arrangements, the column shape of the pivot shaft portions 30A may be made up of a cylindrical column located on the rear side and a rectangular prism located on the front side, which are bonded in the front-rear direction.

As shown in FIG. 4, the right and left frames 30R and 30L further include engaging protruding portions 35A respectively which are disposed on their rearward sides. The engaging protruding portions 35A are paired with each other and located, in one or more arrangements, between the pivot shaft portions 30A and a middle position or midpoint N1 (e.g., exclusive of the positions of pivot shaft portions 30A and midpoint N1), which is located midway between the pivot shaft portion 30A and a rotation axis C1 of the driven roller 32. The engaging protruding portions 35A sandwich the endless belt 33 in the width-wise direction. As shown in FIG. 5, the engaging protruding portions 35A may have a column shape extending outward in the width direction of the endless belt 33. More specifically, the engaging protruding portions 35A may have a shape in which a column (e.g., a rectangular member) and a triangular prism pointed downward are bonded vertically.

As shown in FIG. 4, the right and left frames 30R and 30L further include vertical positioning protruding portions 34A respectively which are disposed at their front sides. The vertical positioning protruding portions 34A are paired with each other and located between the rotation axis C1 and the middle position N1. The vertical positioning protruding portions 34A sandwich the endless belt 33 in the width-wise direction. As shown in FIG. 5, the vertical positioning protruding portions 34A may have a channel shape and protrude outside in the width direction of the endless belt 33. In one example, protruding portions 34*a* may include an upwardly-exposed channel (e.g., the channel is exposed in the top direction as specified in FIG. 5). The channel of protruding portions 34*a* may also be exposed in a width-wise (e.g., left to right direction as specified in FIG. 5).

As shown in FIGS. 4-8, the right and left sidewalls 3R and 3L, which are lower sidewalls of the frame of the main body and configured to sandwich the belt unit 30 in the width-wise direction, may include right and left pivot support portions 3A, which are paired with each other, right and left lock mechanisms 40 (as an example of fixing mechanisms), which are paired with each other, right and left front-rear direction positioning surfaces 3E, which are paired with each other, and vertical positioning surfaces 3F, which are paired with each other. As the right and left sidewalls 3R and 3L may be identical in structure to each other, the following description is provided based on the left sidewall 3L.

Figure 6:
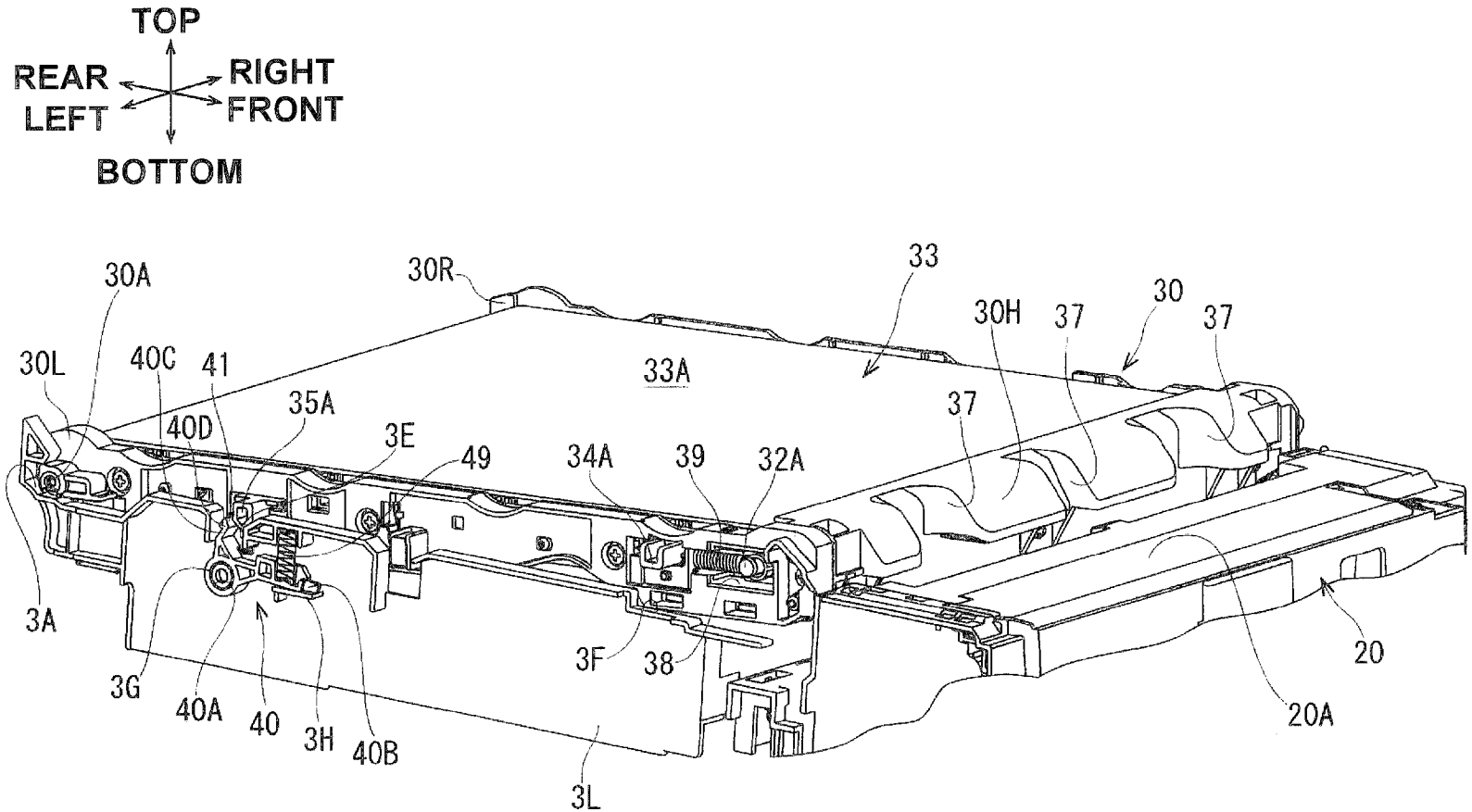
FIG. 6 is a perspective view illustrating the belt unit, the frame, and the sheet supply unit of the image forming apparatus (in a state where the belt unit is not engaged in an operation position)
Figure 8:
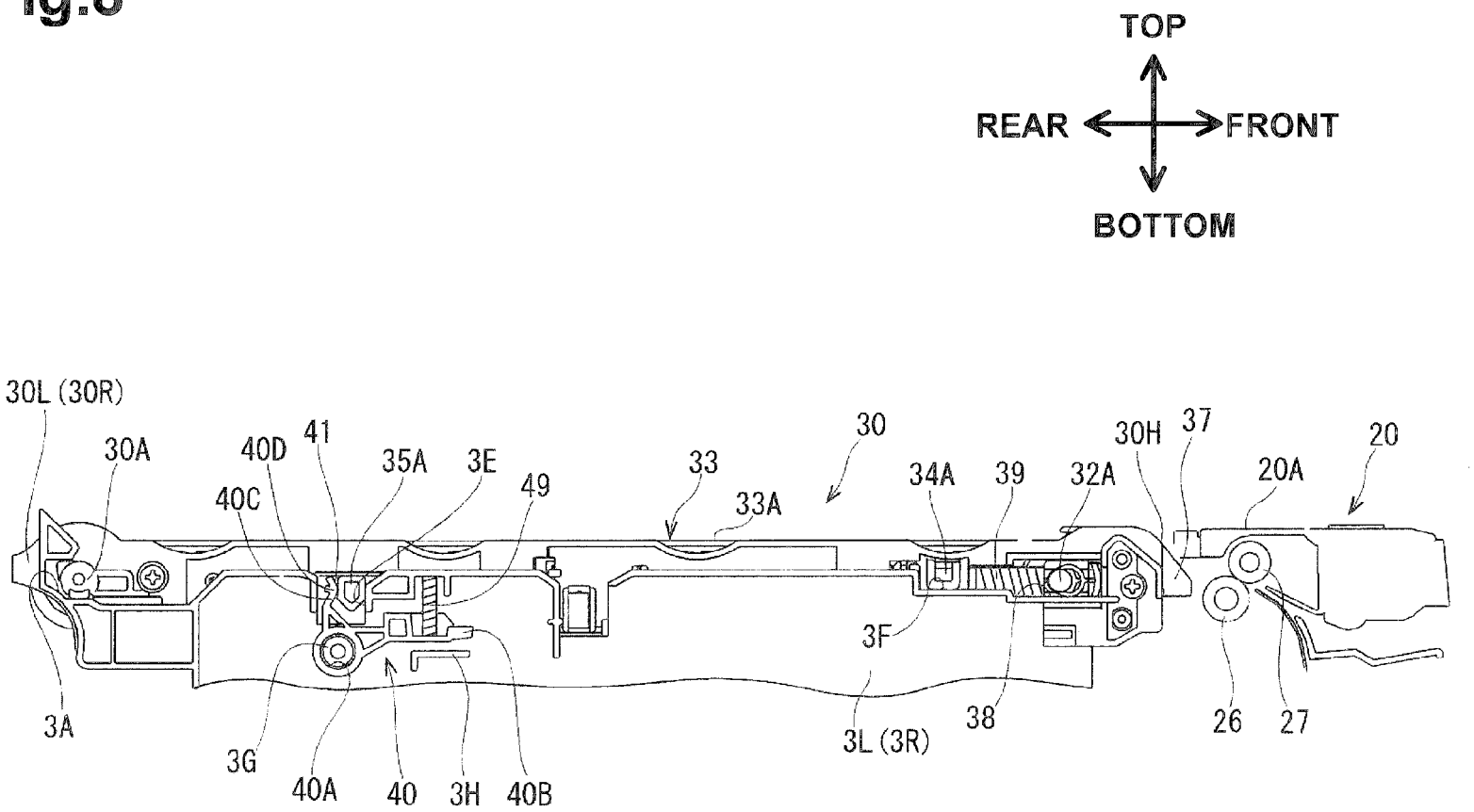
FIG. 8 is a side view illustrating the belt unit, the frame, and the sheet supply unit of the image forming apparatus (in a state where the belt unit is fixed/engaged in the operation position)

As shown in FIG. 5, the pivot support portion 3A is rearwardly recessed on the rear end of the sidewall 3L. As shown in FIG. 6, when the belt unit 30 is attached to the main body, the pivot shaft portion 30A of the belt unit 30 is inserted into and engaged with the pivot support portion 3A. Specifically, the pivot support portion 3A engages with the pivot shaft portion 30A in such a manner that the recessed portion of the pivot support portion 3A sandwiches the top and bottom of the cylindrical column of the pivot shaft portion 30A. Thus, the pivot support portion 3A is configured to support the belt unit 30 such that the belt unit 30 pivots around a pivot axis S1 (shown in FIGS. 3 and 4) of the pivot shaft portion 30A which extends in the left-right direction. FIG. 8 illustrates that the belt unit 30 has pivoted around the pivot axis S1 to the operation position. In this state, the pivot support portion 3A and the pivot shaft portion 30A maintain the vertical position of the belt unit 30 at the rear end of the belt unit 30.

Figure 7:
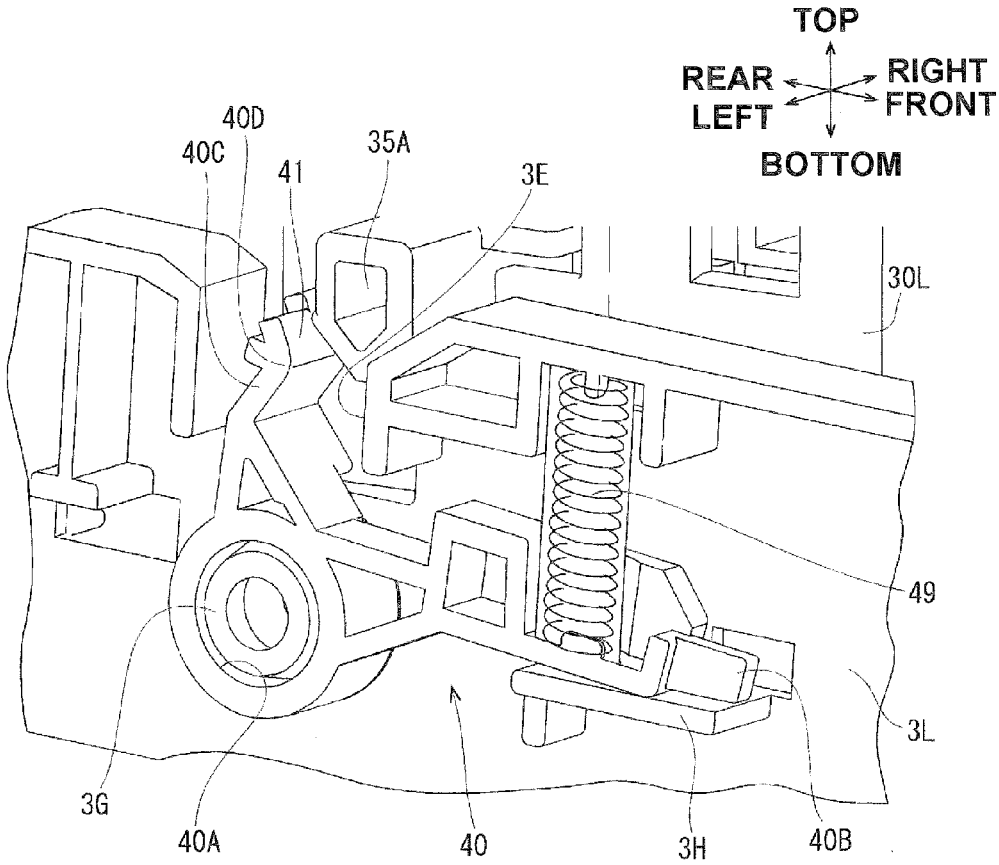
FIG. 7 is a perspective view of a lock mechanism of the image forming apparatus according to an illustrative embodiment.

As shown in FIG. 7, the lock mechanism 40 is substantially L-shaped and includes a shaft hole portion 40A, a passive portion 40B and an operating portion 40C. The shaft hole portion 40A is rotatably supported by a support shaft 3G which protrudes outward in the width direction from the sidewall 3L. The passive portion 40B extends frontward from the shaft hole portion 40A while the operating portion 40C extends upward from the shaft hole portion 40A.

Additionally, a compression coil spring 49 and a stopper portion 3H disposed between the passive portion 40B and the sidewall 3L are provided. The compression coil spring 49 is configured to press the passive portion 40B downward. The stopper portion 3H is configured to restrict a range with which the passive portion 40B rotates around the support shaft 3G.

Figure 9:
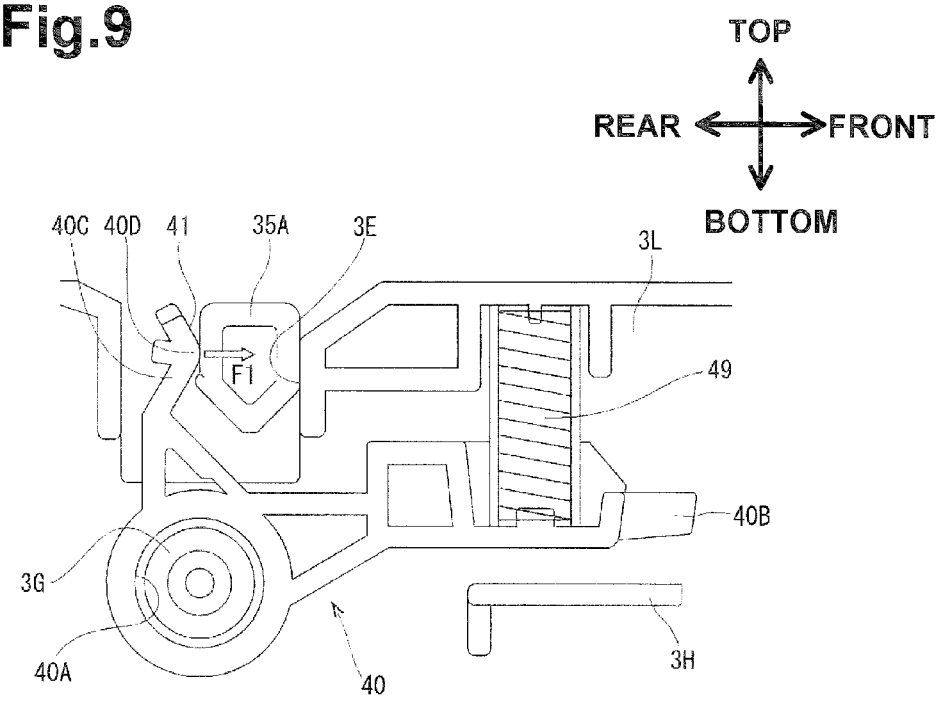
FIG. 9 is a side view of the lock mechanism of the image forming apparatus.

As shown in FIGS. 7 and 9, the upper portion of the operating portion 40C includes a bending portion 40D protruding frontward and a temporarily holding portion 41 which is a surface inclined rearward in an upper portion of the bending portion 40D.

As shown in FIG. 5, the front-rear direction positioning surface 3E is a vertical surface formed by bending the upper end surface of the sidewall 3L downward. The front-rear direction positioning surface 3E is rearward facing and is disposed opposite to the bending portion 40D of the operating portion 40C of the lock mechanism 40. The front-rear direction positioning surface 3E is an example of a contact surface according to aspects described herein. With the belt unit 30 being removed, the operating portion 40C of the lock mechanism 40 pivots frontward around the support shaft 3G due to a pressing force of the compression coil spring 49, and moves close to the front-rear direction positioning surface 3E. At this time, a distance between the temporarily holding portion 41 and the front-rear direction positioning surface 3E is smaller than a maximum width (e.g., width of a rectangular or column portion) of the engaging protruding portion 35A.

When the belt unit 30 pivots around the pivot axis S1, the engaging protruding portion 35A contacts the temporarily holding portion 41 as shown in FIGS. 6 and 7. By setting the pressing force of the compression coil spring 49 appropriately, the distance between the operating portion 40C and the front-rear direction positioning surface 3E is not widened even when the weight of the belt unit 30 acts on the temporarily holding portion 41 via the engaging protruding portion 35A.

When the user presses the handle 30H from above in a state shown in FIG. 6, a triangular prism portion of the engaging protruding portion 35A, which is pointed downward, is inserted between the operating portion 40C and the front-rear direction positioning surface 3E in a manner that widens the distance therebetween, as shown in FIGS. 8 and 9, while causing the lock mechanism 40 to pivot rearward (e.g., counterclockwise in the orientation shown in FIGS. 8 and 9) around the support shaft 3G against the urging force of the compression coil spring 49. The engaging protruding portion 35A has a rectangular or column portion of which front and rear surfaces are vertical in the front-rear direction. The front and rear surfaces of the rectangular or column portion contact the bending portion 40D and the front-rear direction positioning surface 3E, however, the bending portion 40D and the front-rear direction positioning surface 3E do not restrict the vertical position of the engaging protruding portion 35A. As shown in FIGS. 4 and 9, the front-rear direction positioning surface 3E contacts and secures the engaging protruding portion 35A which receives an urging force F1 of the compression coil spring 49 from the bending portion 40D of the operating portion 40C of the lock mechanism 40. For example, the engaging protruding portion 35A is sandwiched and secured directly between the bending portion 40D and the front-rear direction positioning surface 3E. As a result, the belt unit 30 is positioned in the front-rear direction.

As shown in FIG. 5, the vertical positioning surface 3F is a horizontal surface, which is stepped down from the upper end surface at the front side of the sidewall 3L. As shown in FIG. 8, when the belt unit 30 pivots around the pivot axis S1 to the operation position, the vertical positioning surface 3F contacts and supports a bottom surface of the vertical positioning protruding portions 34A. Accordingly, the belt unit 30 is vertically aligned at the front side through the contact between vertical positioning surface 3F and positioning protruding portions 34A.

In the printer 1 structured as described above, to attach the belt unit 30 to the main body, as shown in FIGS. 3 and 5, the user holds the belt unit 30 on the front side (where the handle 30H is provided in proximity to the driven roller 32), inserts the belt unit 30 (rear side first) through the opening 6A into the main body in the attachment direction D1, and engages the pivot shaft portion 30A with the pivot support portion 3A. As shown in FIG. 6, by engagement of the pivot shaft portion 30A with the pivot support portion 3A, the belt unit 30 lowers by its own weight, and the engaging protruding portion 35A contacts the temporarily holding portion 41 and the front-rear direction positioning surface 3E. At this time, the belt unit 30 temporarily stops (e.g., the position of belt unit 30 is temporarily stable) with its front side being raised as shown in FIG. 6.

Subsequently, when the user changes his or her hold on the belt unit 30 to press the handle 30H downward from above, the belt unit 30 pivots around the pivot axis S1 to the operation position. At this time, the bending portion 40D of the lock mechanism 40 contacts the engaging protruding portion 35A while applying the urging force F1 thereto, to position and secure the belt unit 30 in the front-rear direction. At the same time, the pivot support portion 3A, the pivot shaft portion 30A, the vertical positioning protruding portions 34A, and the vertical positioning surface 3F maintain the vertical positioning and alignment of the belt unit 30. As a result, the belt unit 30 can be accurately fixed to the operation position.

The belt unit 30 can be removed from the main body by reversing the above procedure. For example, to remove the belt unit 30, the belt unit 30 can be easily raised by inserting a finger into one of the finger engageable portions 37 and raising the front side (the handle 30H) of the belt unit 30.

In the printer 1 structured as described above, the engaging protruding portion 35A is disposed between the rotation axis C1, which is located on an originating side of the attachment direction D1, and the pivot shaft 30A with respect to the endless belt 33 (e.g., exclusive of the positions of rotation axis C1 and the pivot shaft portions 30A). As shown in FIG. 4, a distance L1 between the pivot axis S1 and a location where the lock mechanism 40 applies the urging force F1 to the engaging protruding portion 35A is smaller than a distance L2 between the pivot axis S1 and a pressing position/location (e.g., the handle 30H) where the user presses the belt unit 30 to the operation position. When the distance L1 is smaller than the distance L2, the user can press the handle 30H with a relatively small force. In particular, as the engaging protruding portion 35A is disposed closer to the pivot shaft portion 30A (rather than the middle position N1), the distance L1 becomes even smaller than the distance L2. As a result, in comparison with prior art printers, the printer 1 can greatly reduce the effects of the urging force F1 of the lock mechanism 40 on the user, e.g., when the user is attempting to attach the belt unit 30 in the operation position. The configuration of printer 1 may further significantly reduce the pressing force required for pressing the belt unit 30 downward to the operation position. Similarly, the printer 1 can greatly reduce the force required for the user to pull the belt unit 30 up when removing the belt unit 30.

Thus, the printer 1 of the embodiment can facilitate attachment and removal of the belt unit 30.

In printer 1, when the belt unit 30 is attached, as shown in FIG. 5, the belt unit 30 can be temporarily held at the temporarily holding portion 41 before the belt unit 30 pivots around the pivot axis S1 into the operation position. Thus, the user may be better able to change his or her hold on the belt unit 30, for example, from a position in which it is easy to hold the belt unit 30 for attachment, (e.g. using the handle 30H) to a position in which it is easy to press the belt unit 30 to the operation position, (e.g. using the finger engageable portions 37). In addition, when pivoting the belt unit 30 from the temporary stop position to the operation position, the user may receive physical feedback such as a click, indicating and confirming that the belt unit 30 is in the operation position. As a result, ease of operation for attachment of the belt unit 30 can be improved.

In other systems, removal of the belt unit 30 typically involves the user inserting his/her hand through the opening 6A into a narrow space inside the main body to remove the belt unit 30 while raising the front end of the belt unit 30. Using the configuration described herein, the belt unit 30 may be at least temporarily held by the holding portion 41 with the belt unit's 30 front end being raised as shown in FIG. 6. With the belt unit's 30 front end being raised, the user may be better able to change his or her hold on the belt unit 30 for easier removal. Thus, ease of operation for removal of the belt unit 30 can be improved.

In addition, as the sheet supply unit 20 is fixed in the main body of the printer 1, recording sheets can be supplied to the belt unit 30 with stability as compared to a configuration in which both the belt unit 30 and the sheet supply unit 20 are detachably attached to the main body.

Figure 10:
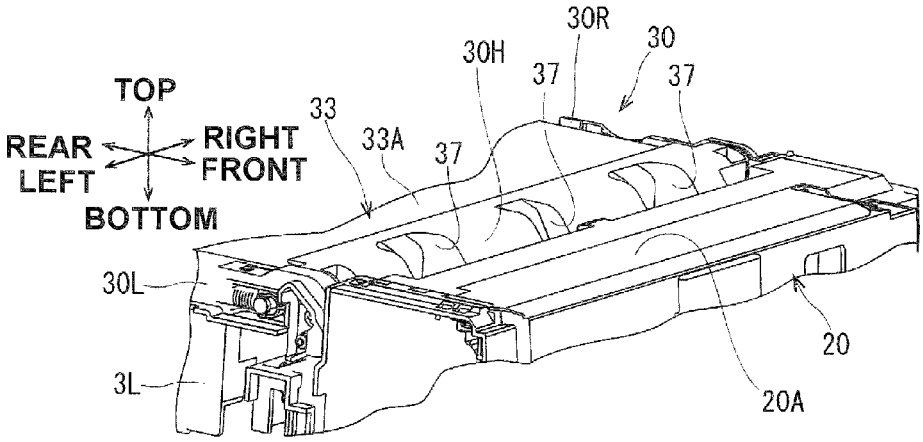
FIG. 10 is a perspective view of an example finger engageable portion and the sheet supply unit of the image forming apparatus.

However, if the sheet supply unit 20 is fixed adjacently to the belt unit 30 on a side closer to the front cover 6, that is, on the front side of the main body, when the belt unit 30 is removed, it may be hard to see the belt unit 30 from the opening 6A or to insert a hand to grasp the belt unit 30. In the printer 1, however, as shown in FIG. 10, the top surface of the handle 30H and the sheet feeding surface 33A are flush with the top surface 20A of the sheet supply unit 20, and the sheet supply unit 20 is out of the way of normal vision from the opening 6A although the sheet supply unit 20 is disposed on the front-most side. Thus, the belt unit 30 can be easily seen from the opening 6A, so that the user can easily insert his/her hand inside. As a result, ease of operation for removal of the belt unit 30 is improved.

Additionally, the printer 1 eliminates any objects protruding upward from the belt unit 30 by forming the finger engageable portions 37 as shown in FIG. 10. Thus, when the image forming unit 10 is pulled through the opening 6A outward, the belt unit 30 may be out of the way because the finger engageable portions 37 are recessed. Furthermore, the opening 6A may be narrowed vertically since belt unit 30 does not include any obstacles protruding upward that would require additional vertical clearance. In addition, when the belt unit 30 is removed from the main body, the user may insert his/her finger into one of the finger engageable portions 37 to raise the belt unit 30. The handle 30H of the belt unit 30 can also be easily raised using the finger engageable portions 37 despite the front side of the sheet supply portion 20 is disposed in front of the belt unit 30. Thus, interference with the ease of operation during removal may be minimized or eliminated.

In the printer 1, the left and right lock mechanisms 40 equally apply the frontward urging force F1 to the left and right engaging protruding portions 35A, respectively. The left and right engaging protruding portions 35A that receive the urging force F1 contact and stop at the left and right front-rear direction positioning surfaces 3E of the sidewalls 3L and 3R. Each of the engaging protruding portions 35A is directly sandwiched and secured between the lock mechanism 40 and the front-rear direction positioning surface 3E. Thus, the belt unit 30 is fixed in the operation position. As a result, the belt unit 30 can be accurately fixed in position. This structure can reduce horizontal displacement of the belt unit 30 caused by rotation relative to a horizontal surface. With the above structure, the urging force F1 of the lock mechanisms 40 can be applied to the engaging protruding portions 35A as a compressive load. Thus, this structure can minimize the effect of the urging force F1 on the right and left frames 30R and 30L as compared to a configuration in which the urging force F1 of the lock mechanisms 40 is received at the engaging protruding portions 35A and positioning portions provided on the right and left frames 30R, 30L contact and stop at the sidewall 3R, 3L. Thus, the likelihood of elastic deformation and creep deformation of the belt unit 30 (for example, the right frame 30R and the left frame 30L) caused by the urging force F1 of the lock mechanism 40 may be minimized or eliminated.

According to another aspect, in the printer 1, the belt unit 30 includes, on each side, the opening or hole 38 and the compression coil spring 39, which function as a mechanism that applies tension to the endless belt 33. In comparison with prior art printers, it is thus not necessary to provide the lock mechanism 40 with a mechanism that applies tension to the belt. As such, the printer 1 has a high degree of flexibility in where to position the lock mechanism 40. As a result, the lock mechanism 40 can be located in a more effective position.

The lock mechanism 40 may urge the engaging protruding portion 35A in any direction in a structure where the belt unit 30 can be fixed in the operation position.

In the above illustrative embodiments, the disclosure is applied to, but not limited to, a direct tandem type image forming apparatus.

The above illustrative embodiment shows, but is not limited to, the image forming apparatus being provided with the scanner unit 60 that emits laser beams. The scanner unit 60 may be replaced with an exposure device using LED arrays.

The above illustrative embodiment shows, but is not limited to, that the top surface of the handle 30H and the sheet feeding surface 33A are flush with the top surface 20A of the sheet supply unit 20. The top surface of the handle 30H and the sheet feeding surface 33A may be higher than the top surface 20A of the sheet supply unit 20 if desired.

In the above illustrative embodiments, the belt unit 30 is configured to feed a recording medium. However, the disclosure is not limited to this kind of belt unit. The disclosure may be applied to a belt unit of intermediate transfer type in which a developer image formed on a belt is transferred onto a recording sheet. Belt units may include a variety of belt unit types including belt units that convey recording mediums and belt units that convey developer images to recording mediums.

Although an illustrative embodiment and examples of modifications of the present disclosure have been described in detail herein, the scope of the disclosure is not limited thereto. It will be appreciated by those skilled in the art that various modifications may be made without departing from the scope of the disclosure. Accordingly, the embodiment and examples of modifications disclosed herein are merely illustrative. It is to be understood that the scope of the disclosure is not to be so limited thereby, but is to be determined by the claims which follow.

What is claimed is:

1. An image forming apparatus comprising:

a main body having an opening;

an image forming unit disposed in the main body and having an image carrier, the image forming unit being configured to form an image on the image carrier;

a belt unit detachably attached in an operation position where the belt unit faces the image forming unit in the main body, the belt unit including:

a first roller disposed at a first end of the belt unit, a second roller disposed at a second end of the belt unit, an endless belt extending between the first roller and the second roller, and a pivot shaft portion disposed at the first end;

a fixing mechanism configured to fix the belt unit in the operation position; and an engaging portion configured to engage the fixing mechanism and to receive an urging force from the fixing mechanism, such that the belt unit is fixed in the operation position, wherein the engaging portion is disposed between the pivot shaft portion and a midpoint between a rotation axis of the second roller and the pivot shaft portion, wherein the main body further includes a pivot support portion configured to support the pivot shaft portion such that the belt unit pivots around a pivot axis disposed along the pivot shaft portion, and wherein the fixing mechanism is configured to fix the belt unit in the operation position by applying the urging force to the engaging portion when the belt unit pivots around the pivot axis.

2. The image forming apparatus according to claim 1, wherein the main body includes the fixing mechanism and the belt unit includes the engaging portion.

3. The image forming apparatus according to claim 2, wherein the engaging portion protrudes from the belt unit.

4. The image forming apparatus according to claim 3, wherein the engaging portion protrudes from the belt unit in a width-wise direction of the endless belt.

5. The image forming apparatus according to claim 1, wherein the engaging portion is disposed closer to the pivot shaft portion than to the midpoint between the pivot shaft portion and the rotation axis of the second roller.

6. The image forming apparatus according to claim 1, wherein the fixing mechanism includes a holding portion that is configured to contact the engaging portion as the belt unit pivots around the pivot axis and to at least temporarily hold the belt unit in a position short of the operation position.

7. The image forming apparatus according to claim 1, wherein the main body further includes a sheet supply portion adjoining the belt unit, wherein the sheet supply portion is fixed to the main body at a side of the main body corresponding to the opening, and is configured to feed a recording medium to the belt unit, and wherein a top surface of the belt unit is flush with or higher than a top surface of the sheet supply portion.

8. The image forming apparatus according to claim 7, wherein the image forming unit is removable from the main body through the opening while passing over the belt unit and the sheet supply portion, and wherein the belt unit includes a recessed finger engageable portion on a side adjoining the sheet supply portion in the main body.

9. The image forming apparatus according to claim 1, wherein the main body includes a frame that is configured to support the belt unit in the operation position, wherein the frame includes a contact surface facing the fixing mechanism and configured to contact and secure the engaging portion, and wherein the fixing mechanism and the contact surface are configured to fix the belt unit in the operation position by directly sandwiching the engaging portion therebetween.

10. The image forming apparatus according to claim 1, further comprising another engaging portion and another fixing mechanism, wherein the endless belt is disposed between the engaging portions in a width-wise direction, and wherein the fixing mechanisms are disposed in positions to engage the engaging portions.

11. An image forming apparatus comprising:

a main body having an opening;

an image forming unit disposed in the main body and having an image carrier, the image forming unit being configured to form an image on the image carrier;

a belt unit detachably attached in an operation position where the belt unit faces the image forming unit in the main body, the belt unit including:

a first roller disposed at a first end of the belt unit, a second roller disposed at a second end of the belt unit, an endless belt extending between the first roller and the second roller, and a pivot shaft portion disposed at the first end;

a fixing mechanism configured to fix the belt unit in the operation position; and an engaging portion configured to engage the fixing mechanism and to receive an urging force from the fixing mechanism, such that the belt unit is fixed in the operation position, wherein the engaging portion is disposed between a rotation axis of the second roller and the pivot shaft portion, wherein the main body further includes a pivot support portion configured to support the pivot shaft portion such that the belt unit pivots around a pivot axis disposed along the pivot shaft portion, wherein the fixing mechanism is configured to fix the belt unit in the operation position by applying the urging force to the engaging portion when the belt unit pivots around the pivot axis, wherein the first roller of the belt unit is a drive roller and the second roller of the belt unit is a driven roller, and wherein the belt unit further includes:

a belt unit body; and an urging member configured to apply a tension to the endless belt by urging the driven roller in a direction away from the drive roller, wherein the endless belt is wound around the drive roller and the driven roller.

12. An image forming apparatus comprising:

a main body having an opening;

an image forming unit disposed in the main body and configured to form an image on a recording medium;

a belt unit detachably attached in an operation position where the belt unit faces the image forming unit in the main body, the belt unit including, a first roller, a second roller, and an endless belt wound around the first roller and the second roller and being configured to rotatably hold the endless belt to feed the recording medium; and a lock mechanism disposed in the main body, the lock mechanism being configured to fix the belt unit in the operation position by applying an urging force to the belt unit, wherein the belt unit is attached in the operation position along an attachment direction in which the belt unit is inserted from outside of the main body through the opening into the main body and toward the operation position, wherein the belt unit includes a pivot shaft portion that is disposed on a front side relative to the attachment direction and an engaging protruding portion that protrudes outward in a width-wise direction of the endless belt, wherein the engaging protruding portion is disposed between a rotation axis of the second roller disposed on a rear side relative to the attachment direction and the pivot shaft portion, wherein the main body includes a pivot support portion that is disposed on the front side relative to the attachment direction and is configured to engage the pivot shaft portion and support the belt unit pivotally around a pivot axis, wherein the pivot axis is horizontal and perpendicular to the attachment direction, and wherein the lock mechanism is configured to fix the belt unit in the operation position by applying the urging force to the engaging protruding portion when the belt unit pivots around the pivot axis.

13. The image forming apparatus according to claim 12, wherein the engaging protruding portion is disposed closer to the pivot shaft portion than to a midpoint between the pivot shaft portion and the rotation axis of the second roller.

14. The image forming apparatus according to claim 12, wherein the lock mechanism includes a holding portion that is configured to contact the engaging protruding portion as the belt unit pivots around the pivot axis and to at least temporarily hold the belt unit in a position short of the operation position.

15. The image forming apparatus according to claim 12, wherein the main body includes a sheet supply portion adjoining the belt unit, wherein the sheet supply portion is fixed at a side of the main body corresponding to the opening, and is configured to feed the recording medium to the belt unit, and wherein a top surface of the belt unit is flush with or higher than a top surface of the sheet supply portion.

16. The image forming apparatus according to claim 15, wherein the image forming unit is removable from the main body through the opening while passing over the belt unit and the sheet supply portion, and wherein the belt unit includes a recessed finger engageable portion on a side adjoining the sheet supply portion in the main body.

17. The image forming apparatus according to claim 12, wherein the main body includes a frame that is fixed in position and configured to support the belt unit in the operation position, wherein the frame includes a contact surface facing the lock mechanism and configured to contact and secure the engaging protruding portion, and wherein the lock mechanism and the contact surface are configured to fix the belt unit in the operation position by directly sandwiching the engaging protruding portion therebetween.

18. The image forming apparatus according to claim 12, further comprising another engaging portion and another lock mechanism, wherein the endless belt is disposed between the engaging protruding portions in the width-wise direction, and wherein the lock mechanisms are disposed in positions to engage the engaging protruding portions.

19. The image forming apparatus according to claim 12, wherein the belt unit includes a belt unit body and a tension applying mechanism, wherein the first roller includes a drive roller rotatably disposed at a front side of the belt unit body relative to the attachment direction, wherein the second roller includes a driven roller rotatably disposed at a rear side of the belt unit body relative to the attachment direction, and wherein the tension applying mechanism is disposed between the belt unit body and the driven roller, the tension applying mechanism being configured to urge the driven roller in a direction away from the drive roller.

20. The image forming apparatus according to claim 12, wherein the engaging protruding portion is disposed between the pivot shaft portion and a midpoint between the pivot shaft portion and the rotation axis of the second roller.

* * * * *